US006379876B1

(12) United States Patent
Irving et al.

(10) Patent No.: US 6,379,876 B1
(45) Date of Patent: Apr. 30, 2002

(54) THERMALLY PROCESSABLE IMAGING ELEMENT COMPRISING AN ION EXCHANGED REDUCING AGENT

(75) Inventors: Mark E. Irving; Lyn M. Irving; John M. Noonan, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/593,086

(22) Filed: Jun. 13, 2000

(51) Int. Cl.[7] ..... G03C 1/498

(52) U.S. Cl. ..... 430/350; 531/617; 531/619; 531/955; 531/957; 531/959

(58) Field of Search ..... 430/619, 617, 430/350, 531, 218, 224, 234, 249, 955, 957, 959

(56) References Cited

U.S. PATENT DOCUMENTS 3,342,599 A 9/1967 Reeves
4,060,418 A 11/1977 Waxman et al.
4,157,915 A 6/1979 Hamaoka et al.
4,438,195 A 3/1984 Kunitz et al.
5,019,492 A 5/1991 Buchanan et al.

*Primary Examiner*—Thorl Chea
(74) *Attorney, Agent, or Firm*—Chris P. Konkol

(57) ABSTRACT

This invention comprises a thermally processable element comprising at least one imaging layer on a support, wherein the imaging element also comprises at least one photographically useful reducing agent ionically bound to an ion exchange matrix. The imaging element preferably is a photothermographic element in which the imaging layer comprises a light sensitive silver halide, an oxidizing agent, preferably an organic silver salt, and a reducing agent.

The invention also comprises developing said photothermographic element by heating the element to a temperature above about 50° C.

The invention also comprises a methods of forming an image by scanning the developed photothermographic element.

33 Claims, 2 Drawing Sheets

THERMALLY PROCESSABLE IMAGING ELEMENT COMPRISING AN ION EXCHANGED REDUCING AGENT

FIELD OF THE INVENTION

This invention pertains to a thermally processable imaging element, and in particular to a thermally processable imaging element incorporating an ion exchanged reducing agent.

BACKGROUND OF THE INVENTION

It is well known in the art that the introduction of photographically useful compounds, such as photographic developers, couplers, development inhibitors, electron transfer agents, base precursors, fixing agents, i.e., ligand capable of binding silver, silver stabilizing agents and the like, into photographic, thermographic and photothermographic elements can lead to premature reaction of the photographically useful compound with the other components of the imaging element. For example, placing conventional color developers, such as p-phenylenediamines and p-aminophenols, into sensitized photographic or photothermographic elements leads to desensitization of the silver halide emulsion and unsuitable fog. Much effort has therefore been directed at trying to produce effective blocked developers, which can be introduced in silver halide emulsion elements without deleterious desensitization or fog effects and which unblock chemically under conditions of development so that developer is free to participate in color forming (dye forming) reactions.

U.S. Pat. No. 3,342,599, to Reeves, discloses the use of Schiff base developer precursors. U.S. Pat. No. 4,157,915, to Hamaoka et al., and U.S. Pat. No. 4,060,418, to Waxman and Mourning, describe the preparation and use of carbamate blocked p-phenylenediamines. Color developing agents having α-ketoacyl blocking groups are described in U.S. Pat. No 5,019,492.

All of these approaches and inventions have failed in practical product applications because of one or more of the following problems: desensitization of sensitized silver halide; unacceptably slow unblocking kinetics; instability of blocked developer yielding increased fog and/or decreased Dmax after storage; and the requirement of a dinucleophile, such as hydroxylamine, to initiate developer release.

PROBLEM TO BE SOLVED BY THE INVENTION

There has been a need for a thermally processable imaging element incorporating a a reducing agent, which is stable until development. Then, the element can be developed rapidly and easily.

SUMMARY OF THE INVENTION

These and other needs have been satisfied by providing photothermographic and thermographic imaging elements comprising polymers with ion exchangeable groups (ionomers, polyesterionomers, and ion-containing latices) which limit diffusion of a reducing agent under coating conditions. The immobilization of a reducing agent prevents interaction with the imaging layer of thermally processable imaging element under storage conditions. The reducing agent can be released from the ion exchange polymer by raising the temperature to at least 50° C.

One aspect of the invention comprises a thermally processable imaging element comprising at least one thermally processable imaging layer on a support, wherein the imaging element also comprises at least one reducing agent ionically bound to an ion exchange matrix. The imaging element is preferably a photothermographic element comprising an imaging layer comprising a light sensitive silver halide, an oxidizing agent, and a reducing agent.

Another aspect of this invention comprises a method of developing the above-described thermally processable imaging element which comprises heating the element to a temperature of at least about 50° C.

Still another aspect of this invention comprises a method of imaging comprising the steps of:

- forming an image in an imagewise exposed and thermally processed photothermographic element comprising a thermally processable imaging layer and containing a reducing agent ionically bound to an ion exchange resin; said method comprising the steps of:
- scanning said formed image to form a first electronic image representation from said formed image;
- digitizing said first electronic image to form a digital image;
- modifying said digital image to form a second electronic image representation; and
- transforming, storing, transmitting, printing or displaying said second electronic image representation.

A further aspect of this invention comprises a method of forming an image comprising the steps of:

- forming an image in an imagewise exposed photothermographic element comprising a thermally processable imaging layer and containing a reducing agent ionically bound to an ion exchange resin;
- scanning said formed image to form an electronic image representation from said formed image; and
- transforming, storing, transmitting, printing or displaying said electronic image representation.

DETAILED DESCRIPTION OF THE INVENTION

Figure 1:
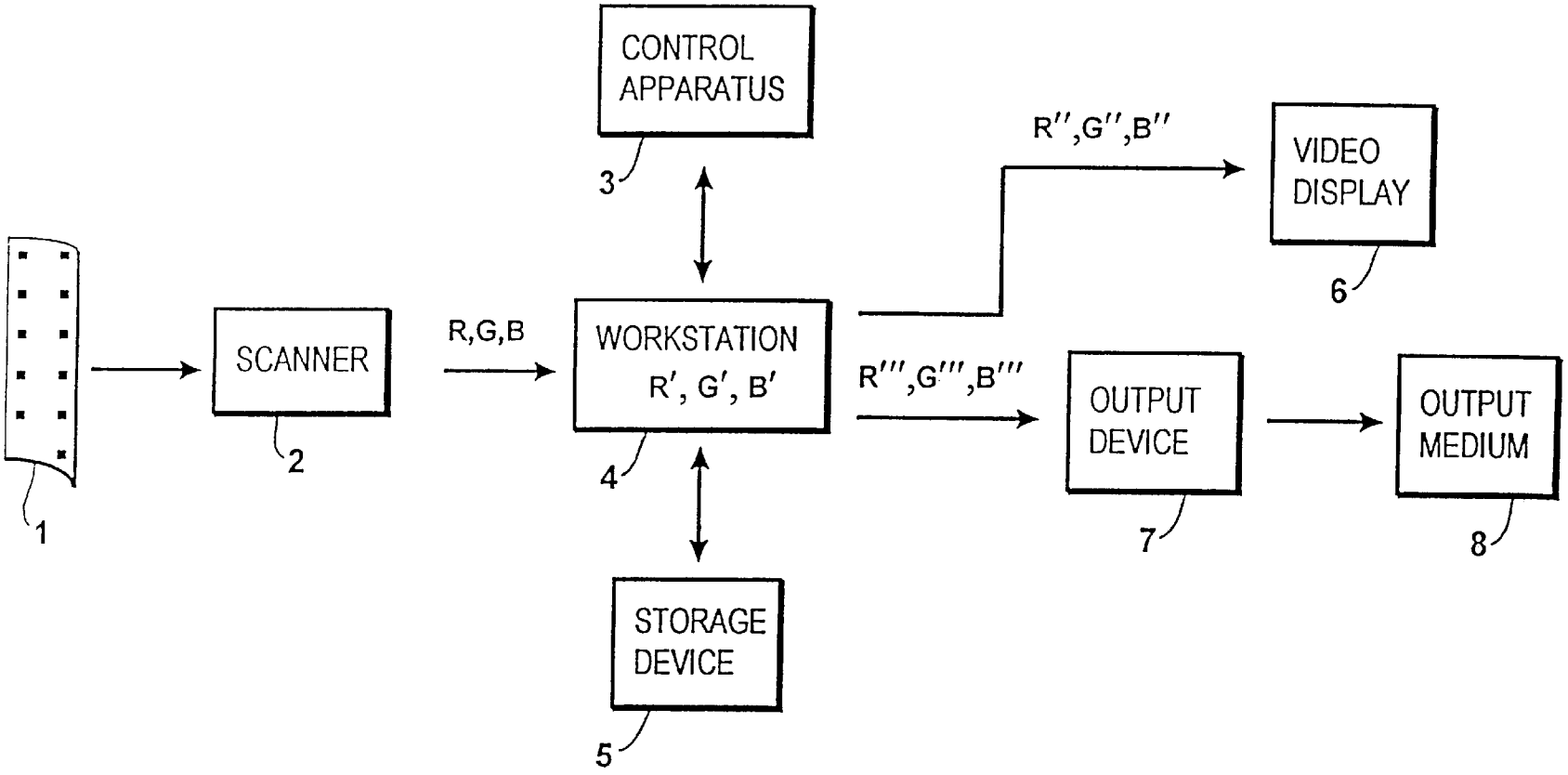
FIG. 1 shows in block diagram form an apparatus for processing and viewing image formation obtained by scanning a photothermographic element of this invention.

The principles of ion exchange are well known and are described, for example, in *Chemical Engineer's Handbook,* Fifth Edition, Section 16. Ion exchange materials generally consist of a solid phase containing bound groups that carry an ionic charge, either positive or negative, in conjunction with free ions of opposite charge that can be displaced. Ion exchange materials have the characteristic of selectively taking up and storing one or more ionized solute species from a fluid phase. The concentration of bound ionic groups in the ion exchange material is called the stoichiometric capacity. The maximum uptake of a specific solute by the ion exchange resin is related to the stoichiometric capacity of the resin and to the adsorption strength of the solute to those bound groups. Ionic exchange resins useful in this invention include, for example, organic synthetic resins, inorganic resins and the like.

Cation-exchange resins generally contain bound sulfonic acid groups (for example, $SO_3^-$). These resins are typically commercially available in either the acidic form or the sodium form. Additionally, cation-exchange resins contain other bound acid groups such as carboxylic, phosphonic, phosphinic, (for example, $COO^-$, $PO_3^{2-}$, $HPO_2^-$, $AsO_2^-$, $SeO_3^-$, etc). Preferred cationic ion exchange resins are sulfonated copolymers derived from styrene and divinylbenzene with a sulfonation level of about 3 to about 5 meq/g.

Anionic-exchange resins involve quaternary ammonium groups (strongly basic) or other amino groups (weakly basic). Such resins preferably contain one or more of the following ionic groups:

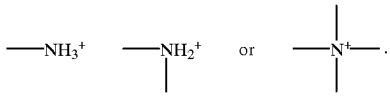

Preferred anionic ion exchange resins are derived from copolymers of styrene and divinylbenzene contain at least one of the above ionic groups. A preferred anionic ion exchange resin comprises a copolymer derived from styrene and divinylbenzene containing trimethylbenzylammonium chloride groups.

Ion exchange reactions are reversible and involve chemically equivalent quantities. It is possible to recover the solute and to purify and reuse the ion exchange resin. In this case, conditions for regeneration must also exist. This can be accomplished with a solution containing the ion initially present in the solid. An ever-present excess of this ion during the regeneration step will cause the reaction equilibrium to reverse itself, restoring the resin to its initial condition.

For use in this invention, the ion exchange preferably comprises particles of about 0.01 to about 10 micrometers ($\mu$m), more preferable about 0.05 to about 8 $\mu$m and most preferably about 0.1 to about 5 $\mu$m. Particles of the desired size can be prepared by standard techniques, such as milling, by preparing the particles by a limited coalescence procedure, or other procedures known in the art.

In accordance with this invention the ion exchange resin is used in a photothermographic element. The ion exchange matrix preferably has a refractive index between 1.4 and 1.7. This provides acceptable optical clarity in the developed photothermographic element.

The photothermographic element of this invention comprises at least one photographically useful reducing agent ionically bound to an ion exchange matrix. The photographic useful reducing agent is present in an amount of about 5 to about 100, preferably about 10 to about 90 and most preferably about 15 to about 90 mol percent of the ion exchange stoichiometric capacity of the ion exchange resin. The terms "acid" and "acidic", "base" and "basic" are used herein to refer to compounds known as Lewis acids and Lewis bases. Acids are molecules or ions capable of coordinating with unshared electron pairs and bases are molecules or ions which have such unshared electron pairs available for coordination. Lewis acids will coordinate with the anionic exchangers, and Lewis bases with the cation exchangers.

The photographically useful reducing agent can be, for example, a photographic developer, a blocked developer, a developer precursor, an electron transfer agent, a blocked electron transfer agent, or an electron transfer agent precursor.

In a preferred embodiment of the invention, the photographically useful reducing agent is a developer. The developer can be an active developer or a blocked developer. A discussion of developers can be found in *Research Disclosure,* September 1996, Number 389, Item 38957 Section XIX, subsection A. September 1996, Number 389, Item 38957 (hereafter referred to as ("*Research Disclosure I*"). All sections referred to herein are sections of *Research Disclosure I,* unless otherwise indicated. (All Research Disclosures referenced herein are published by Kenneth Mason Publications, Ltd., Dudley Annex, 12a North Street, Emsworth, Hampshire P010 7DQ, ENGLAND). The developer can be organic or inorganic. Useful classes of organic developing agents include hydroquinones, catechols, aminophenols, pyrazolidones, phenylene diamines, tetrahydroquinolines, bis(pyridone)amines, cycloalkenones, pyrimidines, reductones and coumarins. Useful inorganic developing agents include compounds of a metal having at least two distinct valence states, which compounds are capable of reducing ionic silver to metallic silver. Such metals include iron, titanium, vanadium and chromium, and the metal compounds employed are typically complexes with organic compounds such as polycarboxylic acids or aminopolycarboxylic acids.

Included among useful developing agents are the iodohydroquinones of Duennebier et al U.S. Pat. No. 3,297,445, the aminohydroxy cycloalkenones of Gabrielsen et al U.S. Pat. No. 3,690,872, the 5-hydroxy and 5-aminopyrimidines of Wyand et al U.S. Pat. No. 3,672,891, the N-acyl derivatives of p-aminophenols of Porter et al U.K. Patent 1,045,303, the 3-pyrazolidones of Kendall U.S. Pat. No. 2,289,367, Allen U.S. Pat. No. 2,772,282, Ishikawa et al U.S. Pat. No. 4,845,016 Stewart et al U.K. Patent 1,023,701 and DeMarle et al U.S. Pat. Nos. 3,221,023 and 3,241,967, the anhydrodihydro reductones of Gabrielsen et al U.S. Pat. No. 3,672,896, the heterocyclic-sulfonhydrazides of Clarke et al EPO 0 545 491, the N-(4-aminophenyl)pyrrolidine derivatives of Ohki et al U.S. Pat. No. 5,278,034, the 6-aminotetrahydroquinolines of Taniguchi et al EPO 0 670 312, the heterocyclic compounds of Hagemann DE 4,241,532, and the 6-hydroxy and 6-aminocoumarins of Oftedahl U.S. Pat. No. 3,615,521. Particularly useful primary aromatic amino color developing agents are the p-phenylenediamines and especially the N-N-dialkyl-p-phenylenediamines in which the alkyl groups or the aromatic nucleus can be substituted or unsubstituted. Common p-phenylenediamine color developing agents are N-N-diethyl-p-phenylenediamine monohydrochloride, 4-N,N-diethyl-2-methylphenylenediamine monohydrochloride, 4-(N-ethyl-N-2-methanesulfonylaminoethyl)-2-methylphenylenediamine sesquisulfate monohydrate, and 4-(N-ethyl-N-2-hydroxyethyl)-2-methylphenylenediamine sulfate. Otherp-phenylenediamines, similar compounds, and their use include those described in Nakamura et al U.S. Pat. No. 5,427,897, Mihayashi et al U.S. Pat. No. 5,380,625, Haijima et al U.S. Pat. No. 5,328,812, Taniguchi et al U.S. Pat. No. 5,264,331, Kuse et al U.S. Pat. No. 5,202,229, Mikoshiba et al U.S. Pat. No. 5,223,380, Nakamuara et al U.S. Pat. No. 5,176,987, Yoshizawa et al U.S. Pat. No. 5,006,437, Nakamuara U.S. Pat. No. 5,102,778 and Nakagawa et al U.S. Pat. No. 5,043,254. Advantageous results can be obtained with combinations of organic and inorganic developing agents as described in Vought *Research Disclosure,* Vol. 150, October, 1976, Item 15034, and with combinations of different types of organic developing agents such as the combination of anhydrodihydroamino reductones and aminomethyl hydroquinones of Youngquist U.S. Pat. No. 3,666,457, the combination of a color developer and a 3-pyrazolidone of Twist WO 92/10789 and the combination of ascorbic acid and 3-pyrazolidone of Suthems U.K. Patent 1,281,516. Developing agents can be incorporated in photographic and photothermographic elements in the form of precursors. Examples of such precursors include the halogenated acyl hydroquinones of Porter et al U.S. Pat. No. 3,246,988, the N-acyl derivatives of aminophenols of Porter et al U.S. Pat. No. 3,291,609, the reaction products of a catechol or hydroquinone with a metal described in Barr U.S. Pat. No. 3,295,978, the quinhydrone dyes of Haefner et al U.S. Pat. No. 3,565,627, the cyclohex-2-ene-1,4-diones and cyclohex-2-ene-1-one-4-monoketals of Chapman et al U.S. Pat. No. 3,586,506, the Schiff bases of p-phenylenediamines of Pupo et al *Research Disclosure,* Vol. 151, November, 1976, Item 15159 and the blocked developers of Southby et al U.S. Pat. No. 5,256,525. Precursors may also be contained in developing solutions as described in Mikoshiba et al EPO 0 393 523 and Yagihara et al U.S. Pat. No. 5,002,862. When incorporated, the developing agents can be present in one or more hydrophilic colloid layers of the photographic or photothermographic element, such as a silver halide emulsion layer or a layer adjacent the silver halide layer, as illustrated by Haefner U.S. Defensive Publication T-882020.

Preferred developers include aminophenols, phenylenediamines, hydroquinones and pyrazolidones. Representative patents describing such developing agents are U.S. Pat. Nos. 2,193,015; 2,108,243; 2,592,364; 3,656,950; 3,658,525; 2,751,297; 2,289,367; 2,772,282; 2,743,279; 2,753,256; and 2,304,953.

Structures of preferred developing agents are:

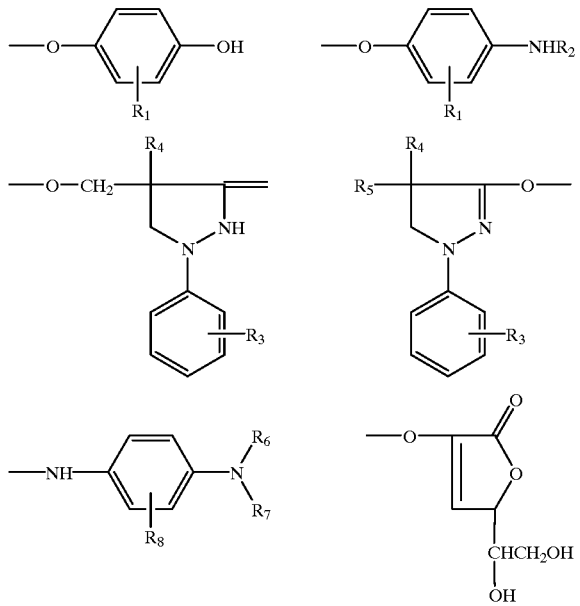

wherein $R_1$ is hydrogen, halogen (e.g. chloro, bromo), alkyl or alkoxy (preferably of 1 to 4 carbon atoms); $R_2$ is hydrogen or alkyl (preferably of 1 to 4 atoms); $R_3$ is hydrogen, alkyl, alkoxy or alkenedioxy (preferably of of 1 to 4 carbon atoms); and $R_4$, $R_5$, $R_6$, $R_7$ and $R_8$ are individually hydrogen, alkyl, hydroxyalkyl or sulfoalkyl (preferably of 1 to 4 carbon atoms).

Particularly preferred developers are, p-phenylenediamines or p-aminophenols. Especially preferred are p-phenylenediamines.

The photothermographic element may also contain a fixing agent (i.e., a ligand that is capable of binding silver. A discussion of fixing agents can be found in *Research Disclosure I* Section XX, subsections B (1) to (4) and Section C.

Fixing agents are solvents for silver halide such as a thiosulfate (e.g., sodium thiosulfate, ammonium thiosulfate, and potassium thiosulfate), a thiocyanate (e.g., sodium thiocyanate, potassium thiocyanate and ammonium thiocyanate), a thioether compound (e.g., ethylenebisthioglycolic acid and 3,6-dithia-1,8-octanediol), a thioglycolic acid or a thiourea, an organic thiol, an organic phosphine, a high concentration of halide, such as bromide or iodide, a mesoionic thiolate compound, and sulfite. These fixing agents can be used singly or in combination. Thiosulfate is preferably used and ammonium thiosulfate, in particular, is used most commonly owing to the high solubility. Alternative counter-ions such as potassium, sodium, lithium, cesium as well as mixtures of two or more cations may be used. Some fixing agents and their use in solid and liquid formulations are described in Mader U.S. Pat. No. 2,748,000, Bard U.S. Pat. No. 3,615,507, Nittel et al U.S. Pat. No. 3,712,818, Smith U.S. Pat. No. 3,722,020, Ling U.S. Pat. No. 3,959,362, Greenwald U.S. Pat. Nos. 4,126,459, 4,211,562, and 4,211,559, Atland et al U.S. Pat. No. 4,378,424, Fyson U.S. Pat. Nos. 5,171,658, 5,244,778 and 5,275,923, Rogers et al U.S. Pat. No. 5,389,501, Kojima et al EPO 0 458 277, EPO 0 431 568, and EPO 0 500 045, Hayashi EPO 0 557 851, Buttner et al EPO 0 610 763, and Kojima et al EPO 0 611 990. Some low ammonia fixing solutions are described in Schmittou et al U.S. Pat. No. 5,183,727, Yoshimoto et al EPO 0 466 510, Fyson EPO 0 550 933 and Szajewski et al EPO 0 605 036, EPO 0 605 038 and EPO 0 605 039.

The photothermographic element may also contain preservatives such as sulfites (e.g., sodium sulfite, potassium sulfite, and ammonium sulfite), bisulfites (e.g., ammonium bisulfite, sodium bisulfite, and potassium bisulfite), metabisulfites (e.g., potassium metabisulfite, sodium metabisulfite, and ammonium metabisulfite), hydroxylamines, hydrazines, bisulfite adducts of carbonyl and aldehyde compounds (e.g., acetaldehyde sodium bisulfite), ascorbic acid, mercapto-substituted N-oxide compounds, and sulfinic acid compounds, e.g. as described in Watanabe et al U.S. Pat. No. 5,288,595. Compounds which may be added to accelerate fixing include polyoxyethylene compounds, amidine salts or amidine thiosulfates, ammonium or amine salts and organic amines, ammonium thiocyanate (ammonium rhodanate), thiourea and thioethers (for example, 3,6-dithia-1,8-octanediol) in combination with thiosulfates. Some fixing accelerators and their use are described in U.K. Patent 1,306,315, Barnes U.S. Pat. No. 2,174,494, *Photographische Industrie,* 40, 249 (1942), Schmittou et al U.S. Pat. No. 5,424,176 and EPO 0 569 008, and Rogers et al EPO 0 578 309. Sulfite fix accelerators are described in Fyson EPO 0 411 760.

In order to adjust the pH of the photothermogaphic element an acid or a base may be added, such as hydrochloric acid, sulfuric acid, nitric acid, acetic acid, bicarbonate, ammonia, potassium hydroxide, sodium hydroxide, sodium carbonate or potassium carbonate. The photothermographic element may contain sequestering agents such as aminopolycarboxylic and phosphonic acids. Some sequesterants and their use are described in Fujita et al U.S. Pat. No. 4,963,474, Craver et al U.S. Pat. Nos. 5,343,035 and 5,508,150, and Tappe et al EPO 0 486 909. The photothermographic element may also contain stain reducing agents as described in Sasaki et al U.S. Pat. No. 5,120,635, and surfactants as described in Ueda et al EPO 0 441 309.

Some variations on use of a fixing agent in accordance with this invention includes the fixing cover sheet of Simons WO 93/12462, the fixing agents of Ueda et al U.S. Pat. No.

5,194,368 and Nagashima et al U.S. Pat. No. 5,066,569, and the solid formulations of Kim et al U.S. Pat. No. 5,270,154.

The photothermographic element may contain bleaching and fixing agents alone or in combination. Examples of bleaching and fixing agents used in combination use are further described in Hall et al U.S. Pat. No. 4,717,649, Ueda et al U.S. Pat. No. 4,818,673, Abe et al U.S. Pat. No. 4,857,441, Haseler et al U.S. Pat. No. 4,933,264, Ishikawa et al U.S. Pat. No. 4,966,834, Spriewald et al U.S. Pat. No. 4,987,058, Long et al U.S. Pat. No. 5,055,382, Abe et al U.S. Pat. No. 5,104,775, Goto et al U.S. Pat. No. 5,147,765, Tappe et al U.S. Pat. No. 5,149,618, Ishikawa U.S. Pat. No. 5,169,743, Kobayashi et al U.S. Pat. No. 5,180,656, Yoshida et al U.S. Pat. No. 5,310,633, Fyson U.S. Pat. No. 5,354,647, Ishikawa et al EPO 0 434 097, Goto et al EPO 0 479 262, Nakamura et al EPO 0 565 023, Yoshida et al EPO 0 569 852, Gordon et al EPO 0 590 583 (bleach-fix replenisher) and EPO 0 645 674, Kamada et al EPO 0 686 875, and Wemicke et al German OLS 4,000,482.

The photothermographic element may also contain an image dye forming coupler, a base precursor, an electron transfer agent, a development inhibitor, a thermal solvent, an antifoggant, or any other photographically useful compound.

Image dye-forming couplers are compounds which react with oxidized developer to release a dye. Illustrative couplers include cyan, magenta and yellow image dye-forming couplers that are known in the photographic and photothermographic arts. Illustrative couplers which form cyan dyes upon reaction with oxidized color developing agents are phenols and naphthols. Representative couplers are described in the following patents and publications: U.S. Pat. Nos. 2,367,531; 2,423,730; 2,474,293; 2,772,162; 2,801,171; 2,895,826; 3,002,836; 3,034,892; 3,041,236; 3,419,390; 3,476,563; 3,772,002; 3,779,763; 3,996,253; 4,124,396; 4,254,212; 4,296,200; 4,333,999; 4,443,536; 4,457,559; 4,500,635; 4,526,864; 4,690,889; 4,775,616; and in "Farbkuppler ein Literaturuibersicht," published in Agfa Mitteilungen, Band III, pp. 156–175 (1961). Illustrative magenta dye-forming couplers are pyrazolones, pyrazolotriazoles, pyrazolobenzimidazoles and indazolones. Typical couplers are described in U.S. Pat. Nos. 1,269,479; 2,311,082; 2,343,703; 2,369,489; 2,600,788; 2,673,801; 2,908,573; 3,061,432; 3,062,653; 3,152,896; 3,519,429; 3,725,067; 3,935,015; 4,120,723; 4,443,536; 4,500,630; 4,540,654; 4,581,326; 4,774,172; European Patent Applications 170,164; 177,765; 284,239; 284,240; and in "Farbkuppler ein Literaturubersicht," published in Agfa Mitteilungen, Band III, pp. 126–156 (1961). Couplers which form yellow dyes upon reaction with oxidized color developing agents are typically acylacetanilides such as benzoylacetanilides and pivalylacetanilides. Representative couplers are described in U.S. Pat. Nos. 2,298,443; 2,407,210; 2,875,057; 3,048,194; 3,265,506; 3,384,657; 3,415,652; 3,447,928; 3,542,840; 3,894,875; 3,933,501; 4,022,620; 4,046,575; 4,095,983; 4,182,630; 4,203,768; 4,221,860; 4,326,024; 4,401,752; 4,443,536; 4,529,691; 4,587,205; 4,587,207; 4,617,256; European Patent Application 296, 793; and in "Farbkuppler ein Literaturubersicht," published in Agfa Mitteilungen, Band III, pp. 112126 (1961).

A base precursor is a substance which releases a basic component by heating . Examples of typical base precursors are described in British Patent 998,949. A preferred base precursor is a salt of a carboxylic acid and an organic base. Examples of preferred carboxylic acids include trichloroacetic acid and trifluoroacetic acid. Examples of preferred bases include guanidine, piperidine, morpholine, p-toluidine and 2-picoline, etc. Guanidine trichloroacetate as described in U.S. Pat. No. 3,220,846 is particularly preferred. Ammonium phthalamates such as 2-butyl-ammonium-N-(2 -butyl) phthalamate, can also be used. Such compounds are described in U.S. Pat. No. 4,088,496. Other useful bases are described in U.S. Pat. Nos. 5,064,742; 4,656,124; 4,455, 363; and 3,761,270.

The term "electron transfer agent" or ETA is employed in its art recognized sense of denoting a silver halide developing agent that donates an electron (becomes oxidized) in reducing $Ag^+$ in silver halide to silver $Ag^-$ and is then regenerated to its original non-oxidized state by entering into a redox reaction with primary amine color developing agent. In the redox reaction the color developing agent is oxidized and hence activated for coupling.

Preferred electron tansfer agents 1-aryl-3-pyrazolidinone derivatives, a hydroquinone or derivative thereof, a catechol or derivative thereof, or an acylhydrazine or derivative thereof. The electron transfer agent pyrazolidinone moieties which have been found to be useful in providing development acceleration finction are derived from compounds generally of the type described in U.S. Pat. Nos. 4,209,580; 4,463,081; 4,471,045; and 4,481,287 and in published Japanese patent application No. 62-123,172. Such compounds comprise a 3-pyrazolidinone structure having an unsubstituted or substituted aryl group in the 1-position. Preferably these compounds have one or more alkyl groups in the 4 or 5-positions of the pyrazolidinone ring. Particularly useful electron ransfer agents are described in Platt et al U.S. Pat. No. 4,912,025, and Michno et al U.S. Pat. No. 4,859,578.

The imaging element can also contain a development inhibitor (DIR). Any DIR which is known in the art, or mixtures of such DIR's, can be used. Such DIR's are described in, for example, U.S. Pat. Nos. 3,227,554; 3,384, 657; 3,615,506; 3,617,291; 3,733,201; 4,248,962; 4,409, 323; 4,546,073; 4,564,587; 4,618,571; 4,684,604; 4,698, 297; 4,737,452; 4,782,012; 5,006,448; 5,021,555; 5,034, 311; EP 255,085; EP 348,139; U.K. 1,450,479; and U.K. 2,099,167.

The ionically bound photographically useful reducing agent may be used in any form of photothermographic element. In a preferred embodiment of the invention the photothermographic element is a color negative film. Prints can be made from the film by conventional optical techniques or by scanning the film and printing using a laser, light emitting diode, cathode ray tube or the like.

A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV Supports of *Research Disclosure I,*

Photothermnographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than about 35 $\mu$m and preferably less than about 25 $\mu$m and most preferably less than about 20 $\mu$m.

Any convenient selection from among conventional radiation-sensitive silver halide emulsions can be incorporated within the layer units and used to provide the spectral absorptances of the invention. Most commonly high bromide or high chloride emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Further, the tabular grains can have either {111 } or {100} major faces. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure,* Item 38957, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photothermographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure,* Item 38957, cited above and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in Research Disclosure, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexa-coordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photothermographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photothermographic elements of the present invention, as is typical, provide the silver halide in the form of an emulsion. Photothermographic emulsions generally include a vehicle for coating the emulsion as a layer of a photothermographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, Item 38957. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photothermographic emulsions. The emulsion can also include any of the addenda known to be useful in photographic and photothermographic emulsions.

While any useful quantity of light-sensitive silver, as silver halide, can be employed in the elements useful in this invention, it is preferred that the total quantity be less than 10 $g/m^2$ of silver. Silver quantities of less than 7 $g/m^2$ are preferred, and silver quantities of less than 5 $g/m^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per $m^2$ of support surface area in the element is preferred so as to realize an exposure latitude of at least 2.7 log E while maintaining an adequately low graininess position for pictures intended to be enlarged. For color display elements, substantially lower silver coating coverages are typically employed.

BU contains at least one yellow dye image-forming coupler, GU contains at least one magenta dye image-forming coupler, and RU contains at least one cyan dye image-forning coupler. Any convenient combination of conventional dye image-forming couplers can be employed. Conventional dye image-forming couplers are illustrated by *Research Disclosure*, Item 38957, cited above, X. Dye image formers and modifiers, B. Image-dye-forming couplers. The photothermographic elements may further contain other image-modifying compounds such as "Development Inhibitor-Releasing" compounds (DIR's). Useful additional DIR's for elements of the present invention, are known in the art and examples are described in U.S. Pat. No. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light-sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photothermographic recording material as exposure varies with low to high light levels. Thus higher proportions of peak light absorbing-spectral sensitizing dyes may be desirable in the slower emulsions of the subdivided layer unit to account for on-peak shielding and broadening of the underlying layer spectral sensitivity.

The interlayers IL1 and IL2 are colloid layers having as their primary ftnction color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure,* Item 38957, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure,* Item 38957, VIII. Absorbing and scattering materials, B. Absorbing materials.

The antihalation layer unit AHU typically contains a processing solution removable or decolorizable light absorbing material, such as one or a combination of pigments and dyes. Suitable materials can be selected from among those disclosed in *Research Disclosure,* Item 38957, VIII. Absorbing materials. A common alternative location for AHU is between the support S and the recording layer unit coated nearest the support.

The surface overcoats SOC are colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure,* Item 38957, IX. Coating physical property modifying addenda. The SOC overlying the emulsion layers additionally preferably contains an ultraviolet absorber, such as illustrated by *Research Disclosure,* Item 38957, VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements useful in the invention produces a dye image characteristic curve gamma of less than 1.5, which facilitates obtaining an exposure latitude of at least 2.7 log E. A minimum acceptable exposure latitude of a multicolor photothermographic element is that which allows accurately recording the most extreme whites (e.g., a bride's wedding gown) and the most extreme blacks (e.g., a bride groom's tuxedo) that are likely to arise in photographic or photothermographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma as low as 1.0 or even 0.6 are contemplated and exposure latitudes of up to about 5.0 log E or higher are feasible. Gammas of about less than about 0.55 are preferred. Gammas of between about 0.4 and about 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure,* Item 38957, X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in Research Disclosure, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in Research Disclosure, Vol. 176, December 1978, Item 17643, XXIII. Image transfer systems.

A number of modifications of color negative elements have been suggested for accommodating scanning, as illustrated by *Research Disclosure I,* XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described by Arakawa et al U.S. Pat. No. 5,962,205, the disclosures of which are incorporated herein by reference, The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following development of the exposed color photographic and photothermographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering,* W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed.

The term "gamma ratio" when applied to a color recording layer unit refers to the ratio determined by dividing the color gamma of a cited layer unit after imagewise color separation exposure and process that enables development of primarily that layer unit by the color gamma of te same layer unit after imagewise white light exposure and process that enables develpmnet of all layer units. This term relates to the degree of color saturation available from that layer unit after conventional optical printing. Larger values of the gamma ratio indicate enhanced degrees of color saturation under optical printing conditions.

Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light-sensitive color forming units each exhibit gamma ratios of less than 1.15. In an even more preferred embodiment, the red and blue light-sensitive color forming units each exhibit gamma ratios of less than 1.10. In a most preferred embodiment, the red, green, and blue light-sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative element is inversely related to the exposure required to enable the attainment of a specified density above fog after processing. Photographic speed for a color negative element with a gamma of about 0.65 in each color record has been specifically defined by the American National Standards Institute (ANSI) as ANS1 Standard Number PH 2.27-1981 (ISO (ASA Speed)) and relates specifically the average of exposure levels required to produce a density of 0.15 above the minimum density in each of the green light-sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photothermographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221. More generally, the size limited cameras most useful as one-time-use cameras will be generally rectangular in shape and can meet the requirements of easy handling and transportability in, for example, a pocket, when the camera as described herein has a limited volume. The camera should have a total volume of less than about 450 cubic centimeters (cc's), preferably less than 380 cc, more preferably less than 300 cc, and most preferably less than 220 cc. The depth-to-height-to-length proportions of such a camera will generally be in an about 1:2:4 ratio, with a range in each of about 25% so as to provide comfortable handling and pocketability. Generally the minimum usable depth is set by the focal length of the incorporated lens and by the dimensions of the incorporated film spools and cartridge. The camera will preferably have the majority of corners and edges finished with a radius-of-curvature of between about 0.2 and 3 centimeters. The use of thrust cartridges allows a particular advantage in this invention by providing easy scanner access to particular scenes photographed on a roll while protecting the film from dust, scratches, and abrasion, all of which tend to degrade the quality of an image.

While any known taking lens may be employed in the cameras of this invention, the taking lens mounted on the single-use cameras of the invention are preferably single aspherical plastic lenses. The lenses will have a focal length between about 10 and 100 mm, and a lens aperture between f/2 and f/32. The focal length is preferably between about 15 and 60 mm and most preferably between about 20 and 40 mm. For pictorial applications, a focal length matching to within 25% the diagonal of the rectangular film exposure area is preferred. Lens apertures of between f/2.8 and f/22 are contemplated with a lens aperture of about f/4 to f/16 being preferred. The lens MTF can be as low as 0.6 or less at a spatial frequency of 20 lines per millimeter (1 pm) at the film plane, although values as high as 0.7 or most preferably 0.8 or more are contemplated. Higher lens MTF values generally allow sharper pictures to be produced. Multiple lens arrangements comprising two, three, or more component lens elements consistent with the functions described above are specifically contemplated.

Cameras may contain a built-in processing capability, for example a heating element. Designs for such cameras including their use in an image capture and display system are disclosed in U.S. patent application Ser. No. 09/388,573, incorporated herein by reference.

Photothermographic elements of the present invention generally are imagewise exposed to light in the visible region of the spectrum, and such exposure is of an image through a lens, although exposure can also be exposure to a stored image (such as a computer stored image) by means of light emitting devices (such as light emitting diodes, CRT and the like). Exposures are monochromatic, orthochromatic, or panchromatic depending upon the spectral sensitization of the light sensitive silver halide.

The elements as discussed above may serve as origination material for some or all of the following processes: image scanning to produce an electronic rendition of the capture image, and subsequent digital processing of that rendition to manipulate, store, transmit, output, or display electronically that image.

In accordance with this invention the ion exchanged photographically useful reducing agent is incorporated in a photothermographic element. Photothermographic elements of the type described in *Research Disclosure* 17029 of June 1978, which is incorporated herein by reference. The photothermographic elements may be of type A or type B as disclosed in said Research Disclosure. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

The photothermographic element comprises a photosensitive component that comprises light-sensitive silver halide.

In the type B photothermographic material it is believed that the latent image silver from the silver halide acts as a catalyst for the described image-forming combination upon processing. In these systems, a preferred concentration of silver halide is within the range of 0.01 to 100 moles of silver halide per mole of silver donor in the photothermographic material. The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 3-mercapto-4-phenyl-1,2,4 triazole, a silver salt of 2-mercaptobenzimidazole, a silver salt of 2-mercapto-5-aminothiadiazole, a silver salt of 2-(2-ethylglycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

It is also found convenient to use silver half soap, of which an equimolar blend of a silver behenate with behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. A method for making silver soap dispersions is well known in the art and is disclosed in Research Disclosure October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic and photothermographic arts, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by Research Disclosure, Item 17029, cited above, as well as U.S. Pat. No. 3,700,458 and published Japanese patent applications Nos. 32928/75, 13224/74, 17216/75 and 42729/76.

The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyanophenylacetic acid derivatives such as ethyl αcyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy- 1,1'-binaphthyl, and bis(2-hydroxy-1-naphthyl) methane; a combination of bis-β-naphthol and a 1,3-dihydroxybenzene derivative, (e. g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3 -t-butyl-5-methylphenyl)-methane; 2,2-bis(4-hydroxy-3-methylphenyl)propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photothermographic element can comprise a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282. Examples of useful toning agents include, for example, phthalimide, N-hydroxyphthalimide, N-potassium-phthalimide, succinimide, N-hydroxy- 1,8-naphthalimide, phthalazine, 1-(2H)-phthalazinone, 2-acetylphthalazinone, salicylanilide, benzamide, and dimethylurea.

The present invention utilizes a thermal solvent to enhance the formation of the dye image, for example by serving as a solvent for the incorporated blocked developer, agents, or otherwise facilitate the resulting development or silver diffusion processes without itself chemically reacting. Thermal solvents for use in dry photothermographic or thermographic systems are generally known, for example, as described in U.S. Pat. No. 3,429,706 (Shepard et al.) and U.S. Pat. No. 3,442,682 (Fukawa et al.). Other dry processing thermographic systems are described in U.S. Pat. No. 3,152,904 (Sorenson et al.) and U.S. Pat. No. 3, 457,075 (Morgan and Shely). Acid amides and carbamates are known as such thermal solvents as disclosed by Henn and Miller (U.S. Pat. No. 3,347,675) and by Yudelson (U.S. Pat. No. 3,438,776). Bojara and de Mauriac (U.S. Pat. No. 3,667, 959) disclose the use of nonaqueous polar solvents containing thione, —SO2 -and—CO-groups as thermal solvents and carriers in such photographic elements. Similarly, La Rossa (U.S. Pat. No. 4,168,980) discloses the use of imidazoline-2-thiones as processing addenda in heat developable photographic materials. Takahashi (U.S. Pat. No. 5,107,454) discloses a microencapsulated base activated heat developable photographic polymerization element containing silver halide, a reducing agent, a polymerizable compound, contained in a microcapsule and separate from a base or base precursor. In addition the element contains a sulfonamide compound as a development accelerator. Thermal solvents for use in substantially dry color photothermographic systems have been disclosed by Komamura et al. (U.S. Pat. No. 4,770,981), Komamura (U.S. Pat. No. 4,948, 698), Aomo and Nakamaura (U.S. Pat. No. 4,952, 479), and Ohbayashi et al. (U.S. Pat. No. 4,983,502). The terms "heat solvent" and "thermal solvent" in these disclosures refer to a non-hydrolyzable organic material which is a liquid at ambient temperature or a solid at an ambient temperature but melts together with other components at a temperature of heat treatment or below but higher than 40° C. Such solvents may also be solids at temperatures above the thermal processing temperature. Their preferred examples include compounds which can act as a solvent for the developing agent and compounds having a high dielectric constant which accelerate physical development of silver salts. Alkyl and aryl amides are disclosed as "heat solvents" by Komamura et al. (U.S. Pat. No. 4,770,981), and a variety of benzamides have been disclosed as "heat solvents" by Ohbayashi et al. (U.S. Pat. No. 4,983,502). Polyglycols, derivatives of polyethylene oxides, beeswax, monostearin, high dielectric constant compounds having an—SO2 -or —CO-group such as acetamide, ethylcarbamate, urea, methylsulfonamide, polar substances described in U.S. Pat No. 3,667,959, lactone of 4-hydroxybutanoic acid, methyl anisate, and related compounds are disclosed as thermal solvents in such systems. The role of thermal solvents in these systems is not clear, but it is believed that such thermal solvents promote the diffusion of reactants at the time of thermal development. Masukawa and Koshizuka disclose (U.S. Pat. No. 4,584, 267) the use of similar components (such as methyl anisate) as "heat fusers" in thermally developable light-sensitive materials. Baxendale and Wood in the Defensive Publication corresponding to U.S. application Ser. No. 825,478 filed Mar. 17, 1969 disclose water soluble lower-alkyl hydroxybenzoates as preprocessing stabilizers in silver salt heat-developable photographic elements. Preferred thermal solvents in the present invenion include salicylanilide and other phenolic compounds or derivatives.

Post-processing image stabilizers and latent image keeping stabilizers are useful in the photothermographic element. Any of the stabilizers known in the photothernographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photothermographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

The layers of the photothermographic element are coated on a support by coating procedures known in the photographic and photothermographic arts, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine. Imagewise exposure is preferably for a time and intensity sufficient to produce a developable latent image in the photothermographic element.

The imaging element of the invention can be a thermographic imaging element. There is a close relationship between many thermographic and photothermographic imaging systems. In general, a photothermographic system can be converted to a thermographic system by replacing the light sensitive silver halide with fog centers, since the amplification chemistry for both can be identical. It is generally accepted that photothermographic systems are more flexible in that they can be used both for image capture and hard copy image output while thermographic systems tend to be used solely for output. For this reason, photothermographic systems are also more difficult to assemble and manufacture.

A photothermographic system contains light sensitive silver halide particles that form latent image centers upon exposure. The chemistry within the film is then capable of amplifying that latent image into a viewable image by the uniform application of heat. The image is rendered by the spatial level of exposure given to the media as well as the time and the temperature of thermal development. Higher temperatures and longer times will give a greater extent of development and higher degree of amplification. A thermographic system contains all the same chemistry necessary for amplification in a photothermographic system, but lacks the light sensitive silver halide. In this scheme, the light sensitive silver halide is generally replaced with catalytic fog centers. These fog centers can be light or chemically fogged silver halide, metallic silver nuclei, silver sulfide particles, palladium sulfide nuclei, and the like. The image is rendered by applying a spatially dependent quantity of energy in an image-wise fashion to the thermographic element. The energy can be modulated with resistive printing heads, infrared laser diode arrays, lasers, IR lens imaging systems, and the like. The energy can be adjusted with radiant exposure time, repeated exposure, changes in wavelength, changes in temperature, gradient masks or negatives, and other means of varying the integrated energy transferred. Thus, image information in a thermographic system is written with spatially delivered thermal energy while image information in a photothermographic system is written by exposure to light and the uniform application of energy.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent applications Ser. Nos. 09/206,586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent application Ser. No. 09/206,914 filed Dec. 7, 1998 and Ser. No. 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

Once yellow, magenta, and cyan dye image records have been formed in the processed photothermographic elements of the invention, conventional techniques can be employed for retrieving the image information for each color record and manipulating the record for subsequent creation of a color balanced viewable image. For example, it is possible to scan the photothermographic element successively within the blue, green, and red regions of the spectrum or to incorporate blue, green, and red light within a single scanning beam that is divided and passed through blue, green, and red filters to form separate scanning beams for each color record. A simple technique is to scan the photothermographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photothermographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management,* Addison-Wesley, 1998.

FIG. 1 shows, in block diagram form, the manner in which the image information provided by the color negative elements of the invention is contemplated to be used. An image scanner 2 is used to scan by transmission an image-wise exposed and processed color negative element 1. The scanning beam is most conveniently a beam of white light that is split after passage through the layer units and passed through filters to create separate image records—red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient element writer, such as a thermal dye transfer, ink-jet, electrostatic, electrophotographic, or other type of printer suitable for rendering a viewable image. The output device can be used to control the exposure of a silver halide color paper. The silver halide output medium and/or its method of processing may be conventional or modified according to the present invention. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 1, the images contained in color negative elements are converted to digital form, manipulated, and recreated in a viewable form following the procedure described in Giorgianni et al U.S. Pat. No. 5,267,030. Color negative recording materials can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data-set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner which produces R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
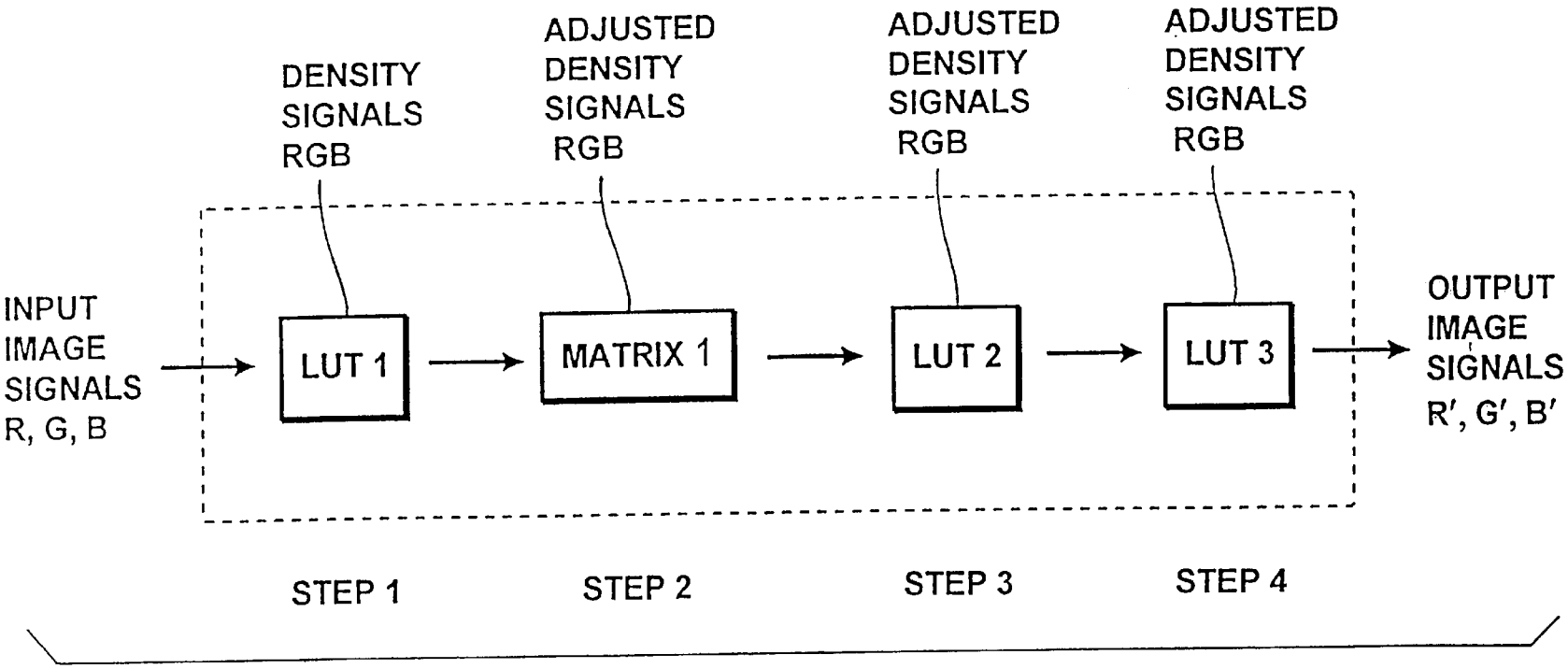
FIG. 2 is a block diagram showing electronic signal processing of image bearing signals derived from scanning a developed color element according to the invention.

Referring to FIG. 2, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values or the output image-bearing signals may require further adjustment to become device specific code values. Such adjustment may be accomplished by firther matrix transformation or 1-dimensional look-up table transformation, or a combination of such transformations to properly prepare the output image-bearing signals for any of the steps of transmitting, storing, printing, or displaying them using the specified device.

The R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material was exposed.

Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the color negative recording material was exposed.

Thus each input film would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUTs may be developed according to the teachings J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

The following examples illustrate the invention and include use of both anionic- and cationic-exchange polymers to stabilize active or blocked color developing agents.

EXAMPLE 1

Preparation of Components for Color Photothermographic Elements

A series of developer loaded ion exchange particle slurries were prepared. Samples of a commercially available ion exchange resin were loaded with developer as described below. Dispersal of the resulting developer loaded ion exchange particles M1–M7 was accomplished by subjecting the particle slurry samples to a) high shear mixing with a rotor-stator mixer and/or b) repeated collisions with hard, inorganic milling media. Direct synthesis of ion exchange resin particles P1 was accomplished via suspension polymerization.

M1

To 40 g of solution A which contained 10 wt. % of DEV-1 and 2.4 wt. % of sodium sulfite were added 10 g of a strongly acidic gel-type ion exchange resin, Amberlite™ IR120$^+$ (a commercially available sulfonated coplymer derived from styrene and divinylbenzene with a sulfonation level equal to ca. 4.5 meq/g). The mixture was stirred for five minutes, and the resin particles were separated from the liquid phase. The resin particles were washed with distilled, de-ionized water until the pH of a 20% resin slurry was 4.7. The resulting developer loaded resin particles were added to 56.6 g of a solution containing 0.111 g of cetyltrimethylammonium bromide and 0.152 g of sodium sulfite. The resin particle slurry was sheared for 15 minutes with a rotor-stator mixer at ca. 15,000 RPM and milled for 16 hours with 120 cc of 1.8 mm zirconium oxide beads in an 8 oz jar.

M2

A sample of Dowex HCR-W2, Na+ form, spherical beads (strong acid; styrene-DVB copolymer; nuclear sulfonic acid active group; total exchange capacity=3.8 meq/g was milled with 1 cm zirconium oxide media for 2 weeks and loaded with developer as follows. In 25 ml of water was dissolved 0.48 g of sodium sulfite followed by a 20 minute purge with nitrogen. To the purged solution was added 5.5 g of DEV-1, and 6.3 g of the 80% solids Dowex HCR-W2 milled dispersion. The resultant dispersion was shaken for 4 hours. The final resin was isolated by centrifugation, and was washed 3 times with distilled water followed by centrifugation each time to isolate the resin. The pH of the resulting 5% solids resin dispersion M2 was 6.0.

M3

To 14.6 g of solution A were added 25.4 g of distilled water and 20 g of Amberlite™ IR120$^+$ strongly acidic gel-type ion exchange resin. The mixture was stirred for five minutes, and the resin particles were separated from the liquid phase. The resin particles were washed with distilled, de-ionized water until the pH of a 20% resin slurry was 4.9. Five grams of the resulting developer loaded resin particles were added to 35 g of a solution containing 0.067 g of cetyltrimethylammonium bromide and 0.09 g of sodium sulfite. This slurry was sheared for 15 minutes with a rotor-stator mixer at ca. 15000 RPM. The resulting slurry was milled for 150 minutes with 120 cc of 1.8 mm zirconium oxide beads in an 8 oz jar to produce ion-exchanged developer M3.

M4

This ion exchange resin was prepared in the same manner as sample M1 except that DEV-2 was used in place of DEV-1 in solution A.

M5

This ion exchange resin was prepared in the same manner as sample M1 except that DEV-3 was used in place of DEV-1 in solution A.

M6

This ion exchange resin was prepared in the same manner as sample M1 except that DEV-4 was used in place of DEV-1 in solution A.

M7

Anionic blocked developer DEV-5 was exchanged to a quatemary ammonium resin as follows. Dowex® SBR (C1$^-$), Type1, Spherical Beads (strong base; styrene-DVB copolymer; trimethylbenzyl ammonium active group; total exchange capacity=3.1 meq/g) ion-exchange resin was milled to generate a dispersion with an average particle size of 0.7 um. To 38 ml of distilled water that had been purged with nitrogen was added 0.48 g of sodium sulfite, and 2 g of DEV-5. To 50 ml of distilled, nitrogen purged water was added 5 g of dried Dowex® SBR (C1$^-$) producing a smooth dispersion. The solution of DEV-5 was added to the resin dispersion, and stirred for 48 hours. The work-up of the developer resin was identical to M2.

P1

Direct synthesis of ion exchange resin particles with the desired particle size was also employed. Ion exchange resin particles were synthesized in the following manner. A copolymer resin comprising 85 wt % styrene, and 15 wt % divinylbenzene was synthesized by the suspension polymerization technique (McCaffery, Edward M.,: *Laboratory Preparation for Macromolecular Chemistry,* McGraw-Hill, Inc., 1970.). The reaction conditions produced a narrow size distribution of particles with the mean size of 3 um. The beads were treated with sulfuric acid at elevated temperatures for 9 hours, thoroughly washed with distilled water, and dried. The level of sulfonation was 6 meq/g. To 30 ml of water was added 0.48 g of sodium sulfite followed by a 20 minute purge with nitrogen. To the purged solution was added 5 g of the 3 um sized sulfonated beads, and 8.5 g of DEV-1. The dispersion was stirred for 4 hours. The isolation procedure of P1 was identical to M2.

DEV-1

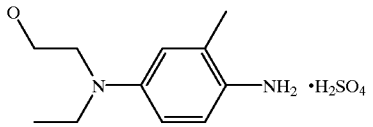

DEV-2

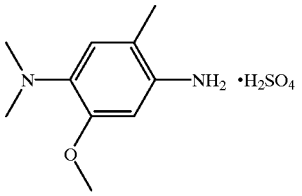

DEV-3

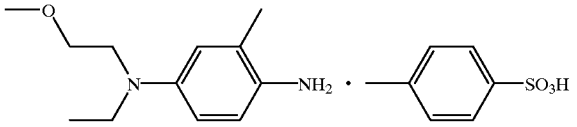

DEV-4

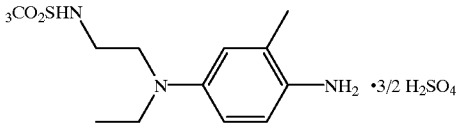

DEV-5

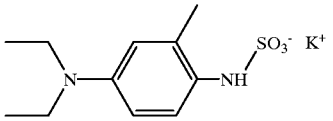

The following two emulsions were prepared.

E1

A silver halide tabular emulsion with a composition of 97% silver bromide and 3% silver chloride was prepared by conventional means. The resulting emulsion had an equivalent circular diameter of 0.6 microns and a thickness of 0.09 microns. The emulsion was spectrally sensitized to blue light and then chemically sensitized for optimum performance.

E2

A silver halide tabular emulsion with a composition of 97% silver bromide and 3% silver iodide was prepared by conventional means. The resulting emulsion had an equivalent circular diameter of 0.6 microns and a thickness of 0.09 microns. This emulsion was spectrally sensitized to green light and then chemically sensitized for optimum performance.

The following coupler dispersion was prepared.

C1

An oil based coupler dispersion was prepared by conventional methods containing coupler COUP-1 and tricresyl phosphate at a weight ratio of 1:0.5.

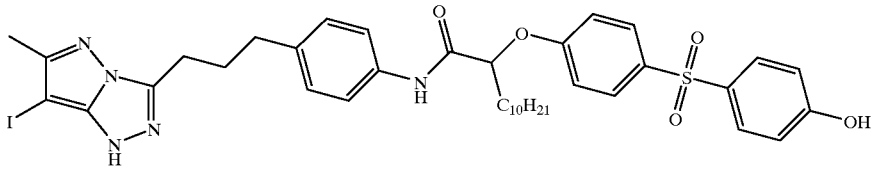

COUP-1

The following antifoggant preparations were prepared.

F1

A ball-milled dispersion of 1 -phenyl-5-mercaptotetrazole was prepared as an aqueous slurry using Zirconia beads and Triton X-200E surfactant.

F2

The silver salt of 1 -phenyl-5-mercaptotetrazole was precipitated by conventional means in a gelatin suspension.

The following light insensitive silver salt was prepared.

S1

The silver salt of 3-amino-5-benzylmercapto-1,2,3-triazole was precipitated by conventional means in a gelatin suspension.

EXAMPLE 2

Color Photothermographic Compositions Containing Ion Exchanged Developer

A photothermographic composition coated on a transparent film support contained 60.9 mg/dm$^2$ of gelatin, 6.46 mg/dm$^2$ of the magenta forming coupler C1, 6.46 mg/dm$^2$ of the radiation insensitive silver salt S1, 6.46 mg/dm$^2$ of silver halide emulsion E1, 10.8 mg/dm$^2$ of salicylanilide, 21.5 mg/dm$^2$ of guanidine trichloroacetate, and 10.8 mg/dm$^2$ of ion exchange resin developer P1.

The coating element was exposed to white light through a 0–4 neutral density step tablet and subsequently thermally processed by contact with a heated platen for 10 seconds at 130° C. An imagewise density signal was observed in magenta dye.

The maximum green Status M density obtained at a variety of processing temperatures is shown in Table I.

TABLE I

Maximum density for dry physical development example 2

| process time/temperature | maximum green density |
|---|---|
| 10 sec/130 C | 0.91 |
| 10 sec/150 C | 1.06 |
| 10 sec/170 C | 1.33 |

A second photothermographic composition coated on a transparent film support contained 60.9 mg/dm$^2$ of gelatin, 6.46 mg/dm$^2$ of the magenta forming coupler C1, 6.46 mg/dm$^2$ of silver halide emulsion E1, 10.8 mg/dm$^2$ of salicylanilide, 21.5 mg/dm$^2$ of guanidine trichloroacetate, and 10.8 mg/dm$^2$of ion exchange resin developer P1. This composition did not contain the radiation insensitive silver salt S1.

The coating element was exposed to white light through a 0–4 neutral density step tablet and subsequently thermally processed by contact with a heated platen for 10 seconds at 170° C. An imagewise density signal was observed in magenta dye. The maximum green Status M density obtained at a variety of processing temperatures is shown in Table II. The density was much lower for this dry chemical development formulation compared to the dry physical development formulation of the previous description.

TABLE II

Maximum density for dry chemical development example 2

| process time/temperature | maximum green density |
|---|---|
| 10 sec/130 C | 0.04 |
| 10 sec/150 C | 0.11 |
| 10 sec/170 C | 0.31 |

EXAMPLE 3

Color Photothermographic Compositions with Improved Image Discrimination

In these descriptions, DPD stands for Dry Physical Development, where light sensitive silver halide is used to detect visible light and processes it into a developable latent image and a light insensitive silver salt is utilized as the coating development oxidant. DCD stands for Dry Chemical Development, where the silver halide particles are used to detect visible light and processes it into a developable latent image and also act as the coating development oxidant.

Preparation of DPD Coating Element 3-1

A photothermographic composition coated on a transparent film support contained 60.9 mg/dm$^2$ of gelatin, 6.46 mg/dm$^2$ of the magenta forming coupler C1, 6.46 mg/dm$^2$ of the radiation insensitive silver salt S1, 6.46 mg/dm$^2$ of silver halide emulsion E1, 10.8 mg/dm$^2$ of salicylanilide, 21.5 mg/dm$^2$ of guanidine trichloroacetate, 3.23 mg/dm$^2$ of antifoggant F1, and 10.8 mg/dm$^2$ of ion exchange resin developer P1.

Preparation of DPD Coating Element 3-2

A photothermographic composition coated on a transparent film support contained 0.9 mg/dm$^2$ of gelatin, 6.46 mg/dm$^2$ of the magenta forming coupler C1, 6.46 g/dm$^2$ of the radiation insensitive silver salt S1, 6.46 mg/dm$^2$ of silver halide emulsion E1, 10.8 mg/dm$^2$ of salicylanilide, 21.5 mg/dm$^2$ of guanidine trichloroacetate, 3.23 mg/dm$^2$ of antifoggant F2, and 10.8 mg/dm$^2$ of ion exchange resin developer P1.

Preparation of DPD Coating Element 3-3

A photothermographic composition coated on a transparent film support contained 60.9 mg/dm$^2$ of gelatin, 6.46 mg/dm$^2$ of the magenta forming coupler C1, 6.46 mg/dm$^2$ of the radiation insensitive silver salt S1, 6.46 mg/dm$^2$ of silver halide emulsion E1,10.8 mg/dm$^2$ of salicylanilide, 3.23 mg/dm$^2$ of antifoggant F1, and 10.8 mg/dm$^2$ of ion exchange resin developer P1.

Preparation of DPD Coating Element 3-4

A photothermographic composition coated on a transparent film support contained 60.9 mg/dm$^2$ of gelatin, 6.46 mg/dm$^2$ of the magenta forming coupler C1, 6.46 mg/dm$^2$ of the radiation insensitive silver salt S1, 6.46 mg/dm$^2$ of silver halide emulsion E1, 10.8 mg/dm$^2$ of salicylanilide, 3.23 mg/dm$^2$ of antifoggant F-2, and 10.8 mg/dm$^2$ of ion exchange resin developer P1.

Preparation of DCD Coating Element 3-5

A photothermographic composition coated on a transparent film support contained 60.9 mg/dm$^2$ of gelatin, 6.46 mg/dm$^2$ of the magenta forming coupler C1, 6.46 mg/dm$^2$ of silver halide emulsion E1, 16.1 mg/dm$^2$ of salicylanilide, 32.3 mg/dm$^2$ of guanidine trichloroacetate, 3.23 mg/dm$^2$ of antifoggant F1, and 10.8 mg/dm$^2$ of ion exchange resin developer P1.

Preparation of DCD Coating Element 3-6

A photothermographic composition coated on a transparent film support contained 60.9 mg/dm$^2$ of gelatin, 6.46 mg/dm$^2$ of the magenta forming coupler C1, 6.46 mg/dm$^2$ of silver halide emulsion E1, 16.1 mg/dm$^2$ of salicylanilide, 32.3 mg/dm$^2$ of guanidine trichloroacetate, 3.23 mg/dm$^2$ of antifoggant F2, and 10.8 mg/dm$^2$ of ion exchange resin developer P1.

Evaluation of Coating Elements 3-1 to 3-6

Coating elements 3-1 through 3-6 were exposed to white light through a 0-4 neutral density step tablet and subsequently thermally processed by contact with a heated platen. A density signal was observed in magenta dye. The minimum and maximum green Status M densities obtained at a variety of processing temperatures is shown in Table III. It is clear that coating formulation is important when using these ion exchange resin developers.

TABLE III

Minimum and maximum densities for coating elements 13-1 to 13-6

| coating element | process time/ temperature | Minimum green density | Maximum green density |
|---|---|---|---|
| 3-1 | 10 sec/100 C | 0.11 | 0.32 |
| 3-1 | 10 sec/110 C | 0.16 | 0.38 |
| 3-1 | 10 sec/120 C | 0.39 | 0.92 |
| 3-2 | 10 sec/100 C | 0.20 | 0.86 |
| 3-2 | 10 sec/110 C | 0.42 | 1.05 |
| 3-3 | 10 sec/100 C | 0.12 | 0.25 |
| 3-3 | 10 sec/110 C | 0.14 | 0.34 |
| 3-3 | 10 sec/120 C | 0.49 | 0.87 |
| 3-4 | 10 sec/100 C | 0.12 | 0.31 |
| 3-4 | 10 sec/110 C | 0.23 | 0.51 |
| 3-5 | 10 sec/150 C | 0.30 | 0.30 |
| 3-5 | 10 sec/170 C | 1.20 | 1.20 |
| 3-6 | 10 sec/130 C | 0.24 | 0.34 |
| 3-6 | 10 sec/150 C | 0.77 | 1.02 |

EXAMPLE 4

Color Photographic Compositions with Improved Developer Solubility

A set of coatings containing ion exchanged developers embedded in a photosensitive layer were prepared, exposed and processed as follows. Coatings were prepared containing on a 1 m$^2$ basis: 0.54 g of silver from silver halide emulsion E2, 0.32 g of magenta dye-forming coupler C1, 0.27 g of developer from the ion-exchanged developer source indicated in Table IV, and 4.04 g of deionized gelatin. The resulting coatings were exposed through a 1–4 nuetral density step tablet and a Wratten 9™ filter for 1" with a 5500K light source.

The set of coatings were processed through a 5 minute pre-bath of distilled water, then immersed in a 0.5M sodium carbonate solution at 60° F. for 30 seconds, fixed, washed and dried. Photographic performance is described in Table IV. Photographic speed was defined as the exposure at which the density above Dmin is 20% of the average gradient from that point to 0.6 log E greater exposure. A comparison coating of DEV-1 was also included which was prepared with the same format except the developer was added using solution A. This coating did not contain ion-exchange particles. This distilled water pre-soaking experiment was used to demonstrate that the ion-exchange polymer adequately limits diffusion of the developer prior to immersion in the activator solution. Because the low pH of the pre-soak bath does not favor silver halide development, mobile developer species are washed out of the coatings without developing exposed silver halide emulsion grains. Subsequent immersion in the activator solution results in image formation from any remaining developer. The results in Table IV show that pre-soaking comparison coating using the solution A source (which does not contain the ion-exchanged polymer) led to nearly complete loss of developer from the coating. As a result, only an extremely faint image was observed upon subsequent treatment with the activator solution. In contrast, the photographic performance of coatings containing ion-exchanged developer sources were not substantially affected by the pre-soak treatment. These results clearly demonstrate the usefulness of the ion-exchange polymers to limit unwanted diffusion of developer species incorporated in silver halide films.

TABLE IV

Example 4 photographic results

| DEV-1 Source | type | Dmin | Dmax | Speed |
|---|---|---|---|---|
| Solution A | comparison | 0.03 | 0.21 | Not measurable |
| M3 | invention | 0.05 | 1.92 | 240 |
| M1 | invention | 0.08 | 2.57 | 251 |
| M2 | invention | 0.05 | 1.91 | 239 |
| P1 | invention | 0.06 | 1.85 | 254 |

EXAMPLE 5

Color Photographic Compositions with Improved Shelf Life

This example demonstrates improvements in photographic performance and shelf life are obtained when ion exchanged developer sources are embedded in a photosensitive layer. Samples of Amberlite IR120$^+$ ion exchange resin were loaded with developing agents DEV-2, DEV-3, and DEV-4 in the same manner as for M1. These are preparations M4 through M6. Coatings were prepared containing on a 1 m$^2$ basis: 0.54 g of silver from silver halide emulsion E2, 0.32 g of magenta dye-forming coupler C1, 0.27 g of developer from the ion-exchanged developer source indicated in Table 4, and 4.04 g of de-ionized gelatin. The resulting coatings were exposed through a 0–4 neutral density step tablet and a Wratten 9™ filter for 1" with a 5500K light source. Processing was immersion in a 0.5 M sodium carbonate solution at 60° F. for 30 seconds, fixed, washed and dried. Photographic performance is described in Table V. Photographic speed was defined as the exposure at which the density above Dmin is 20% of the average gradient from that point to 0.6 log E greater exposure.

Comparison coatings were prepared except the developing agent was added from solution rather than including the ion-exchange resin. The coatings were exposed and processed as described above. A second set of coatings was incubated for four weeks at 120° F. and 50% RH prior to exposure and processing. Photographic performance is described in Table V. The % discrimination was calculated as the ratio of the difference between Dmax and Dmin of the incubated coating and the freshly processed coating. The results in Table V demonstrate that the ion-exchanged developer resins provided similar or superior fresh image discrimination, and speed relative to comparison coatings which did not contain the ion-exchange resin. No image was observed with any of the incubated comparison coatings. Up to 95% of the initial image was retained when the ion exchange resin was employed to stabilize the color developer.

TABLE V

Example 5 photographic results

| Developer Source | type | Fresh Dmin | Fresh Dmax | Fresh Speed | % discrimination for 4 week 120° F. |
|---|---|---|---|---|---|
| M1 | invention | 0.06 | 2.71 | 251 | 94 |
| Solution A | comparison | 0.05 | 2.41 | 214 | 0 (no image) |
| M4 | invention | 0.035 | 0.54 | 194 | 85 |
| DEV-2 Solution | comparison | 0.045 | 0.48 | 193 | 0 (no image) |
| M5 | invention | 0.069 | 2.61 | 230 | 72 |
| DEV-3 Solution | comparison | 0.056 | 2.28 | 230 | 0 (no image) |
| M6 | invention | 0.085 | 2.62 | 221 | 95 |
| DEV-4 Solution | comparison | 0.067 | 2.60 | 143 | 0 (no image) |

EXAMPLE 6

Color Photothermographic Composition Containing a Blocked Developer

This example demonstrates stabilization of a blocked developer using anionic-exchanged resin particles embedded in a photosensitive layer. Anionic blocked developer DEV-5 was exchanged to a quaternary ammonium resin as given in preparation M7. Coatings were prepared containing, on a 1 $m^2$ basis, 0.54 g of silver from silver halide emulsion E2, 0.32 g of magenta dye-forming coupler C1, 0.55 g of DEV-5 from resin M7, 0.004 mmol of nitric acid, and 3.96 g of deionized gelatin. The coating was exposed as described in example 4. The coating was heated for 20 seconds at 160° C. to generate free developer and otherwise processed as described in example 4. A magenta-colored negative image was observed.

The invention has been described in detail with particular reference to certain preferred embodiments thereof, but it will be understood that variations and modifications can be effected within the spirit and scope of the invention.

What is claimed is:

1. A thermographic or photothermographic imaging element comprising at least one thermally processable imaging layer on a support, wherein the imaging element also comprises at least one reducing agent bound ionically to an ion exchange matrix.

2. A thermographic or photothermographic imaging element according to claim 1, wherein said imaging layer comprises a an oxidizing agent and a reducing agent.

3. A thermographic or photothermographic imaging element according to claim 1, wherein the reducing agent is chosen from the group consisting of a photographic developer, a blocked developer, a developer precursor, an electron transfer agent, a blocked electron transfer agent, and an electron transfer agent precursor.

4. A thermographic or photothermographic imaging element according to claim 1, wherein the ion exchange matrix has a refractive index between 1.4 and 1.7.

5. A thermographic or photothermographic imaging element according to claim 1, wherein the ion exchange matrix is an organic synthetic resin.

6. A thermographic or photothermographic imaging element according to claim 5, wherein the ion exchange matrix is a cationic ion exchange resin.

7. A thermographic or photothermographic imaging element according to claim 6, wherein the cationic ion exchange resin carries one or more of the following ionic groups: $SO_3^-$, $COO^-$, $PO_3^{2-}$, $HPO_2^-$, $AsO_2^-$ $SeO_3^-$.

8. A thermographic or photothermographic imaging element according to claim 7, herein the cationic ion exchange resin carries $SO_3^-$ ionic groups.

9. A thermographic or photothermographic imaging element according to claim 7, wherein the cationic ion exchange resin carries $COO^-$ ionic groups.

10. A thermographic or photothermographic imaging element according to claim 7, wherein the cationic ion exchange resin is a sulfonated copolymer derived from styrene and divinylbenzene having a sulfonation level between about 3 to about 5 meq/g.

11. A thermographic or photothermographic imaging element according to claim 5, wherein the ion exchange matrix is an anionic ion exchange resin.

12. A thermographic or photothermographic imaging element according to claim 11, wherein the anionic ion exchange resin carries one or more of the following ionic groups:

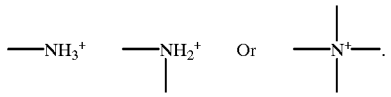

13. A thermographic or photothermographic imaging element according to claim 11, wherein the anionic ion exchange resin comprises a copolymer derived from styrene and divinylbenzene containing trimethylbenzylammonium chloride.

14. A thermographic or photothermographic imaging element according to claim 1, wherein the reducing agent is a developer.

15. A thermographic or photothermographic imaging element according to claim 14, wherein the developer is a color developer.

16. A thermographic or photothermographic imaging element according to claim 14, wherein the developer is a blocked color developer.

17. A thermographic or photothermographic imaging element according to claim 15, wherein the color developer is a p-phenylenediamine or p-aminophenol.

18. A thermographic or photothermographic imaging element according to claim 17, wherein the color developer is a p-phenylenediamine.

19. A thermographic or photothermographic imaging element according to claim 1, wherein the reducing agent is a blocked developer.

20. A thermographic or photothermographic imaging element according to claim 19, wherein the blocked developer releases a p-phenylenediamine.

21. A thermographic or photothermographic imaging element according to claim 1, wherein the reducing agent is an electron transfer agent.

22. A thermographic or photothermographic imaging element according to claim 21, wherein the electron transfer agent is a pyrazolidinone.

23. A thermographic or photothermographic imaging element according to claim 1, wherein the photographically useful reducing agent ionically bound to an ion exchange matrix is in the imaging layer.

24. A thermographic or photothermographic imaging element according to claim 1, further comprising a light-insensitive layer and the reducing agent ionically bound to an ionic exchange matrix is in the light-insensitive layer.

25. A thermographic or photothermographic imaging element according to claim 24, wherein the light-insensitive layer is adjacent to an imaging layer.

26. A thermographic or photothermographic imaging element according to claim 1, wherein the ionic exchange matrix comprises particles with average particle size less than 10 $\mu$m in diameter.

27. A thermographic or photothermographic imaging element according to claim 26, wherein the ionic exchange matrix comprises particles with average particle size less than 5 $\mu$m in diameter.

28. A thermographic or photothermographic imaging element according to claim 1, wherein the ion exchange matrix comprises a water-insoluble polymer.

29. A thermographic or photothermographic imaging element according to claim 1, wherein the photographically useful reducing agent is present in an amount of about 5 to about 100 mol percent of the ion exchange stoichiometric capacity.

30. A method of developing the thermographic or photothermographic imaging element of claim 1 following exposure, which comprises heating the element to a temperature of at least about 50° C.

31. A method of developing the thermographic or photothermographic imaging element of claim 30, which comprises heating the element in an imagewise manner to temperatures of at least about 50° C.

32. A method of forming an image comprising the steps of:

forming an image in an imagewise exposed thermographic or photothermographic element comprising an imaging layer and containing a reducing agent ionically bound to an ion exchange resin, by heating the element in an imagewise manner to temperatures of at least about 50° C.;

scanning said formed image to form an electronic image representation from said formed image; and transforming, storing, transmitting, printing or displaying said electronic image representation.

33. A method of imaging comprising the steps of:

forming an image in an imagewise exposed thermographic or photothermographic element comprising an imaging layer and containing a reducing agent ionically bound to an ion exchange resin, by heating the element in an imagewise manner to temperatures of at least about 50° C.; said method comprising the steps of:

scanning said formed image to form a first electronic image representation from said formed image;

digitizing said first electronic image to form a digital image;

modifying said digital image to form a second electronic image representation; and transforming, storing, transmitting, printing or displaying said second electronic image representation.

* * * * *